US005706609A

United States Patent [19]

Heino

[11] Patent Number: 5,706,609

[45] Date of Patent: Jan. 13, 1998

[54] SNOW GUARD

[76] Inventor: Matti Heino, R.R. #2, Barrie, Ontario, Canada, L4M 4S4

[21] Appl. No.: 331,837

[22] Filed: Oct. 31, 1994

[51] Int. Cl.[6] ..... B61D 17/12

[52] U.S. Cl. ..... 52/24; 248/346.4; 52/783.11; 52/537; 52/674

[58] Field of Search ..... 52/24–26, 537, 52/783.11, DIG. 15, 630, 671, 674, 712, 714, 798.1; 248/346.4

[56] References Cited

U.S. PATENT DOCUMENTS

| | | | |
|---|---|---|---|
| 860,457 | 7/1907 | Frank | 52/24 |
| 1,095,822 | 5/1914 | Danzer | 52/24 |
| 3,820,295 | 6/1974 | Folley | 52/630 X |
| 4,141,182 | 2/1979 | McMullen | 52/24 |
| 5,070,660 | 12/1991 | Willa | 52/24 |

FOREIGN PATENT DOCUMENTS

| | | | |
|---|---|---|---|
| 631226 | 7/1982 | Switzerland | 52/24 |
| 626937 | 12/1987 | Switzerland | 52/24 |

*Primary Examiner*—Wynn E. Wood
*Assistant Examiner*—Beth Aubrey
*Attorney, Agent, or Firm*—Kenneth M. Garrett

[57] ABSTRACT

A snow guard that may be secured to both flat tiled roofs and undulating tiled roofs comprises a corrugated base including a central arched portion flanked by a pair of synclines, with a wing member upstanding from the base. The arrangement is inherently stiff and may be secured to the roof by screws or the like passing through the arched portion or through the synclines.

15 Claims, 2 Drawing Sheets

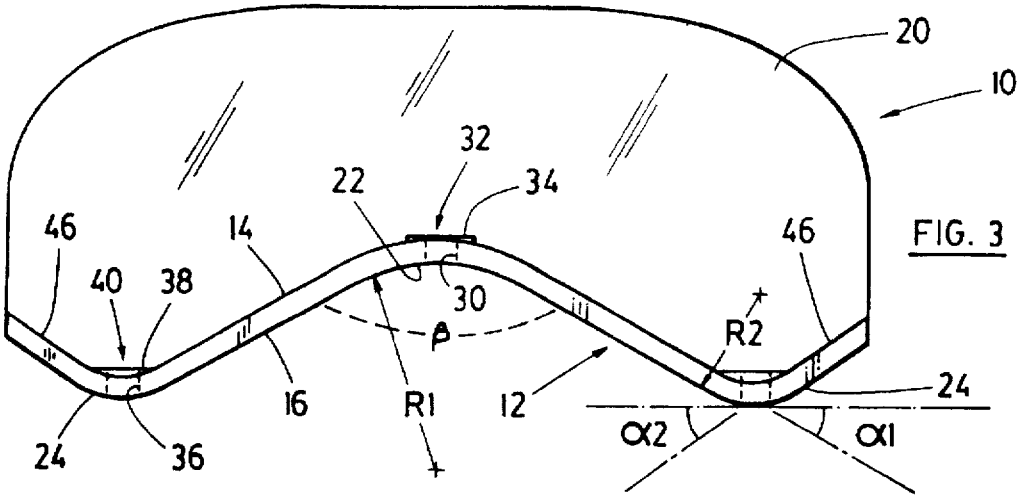
FIG. 3
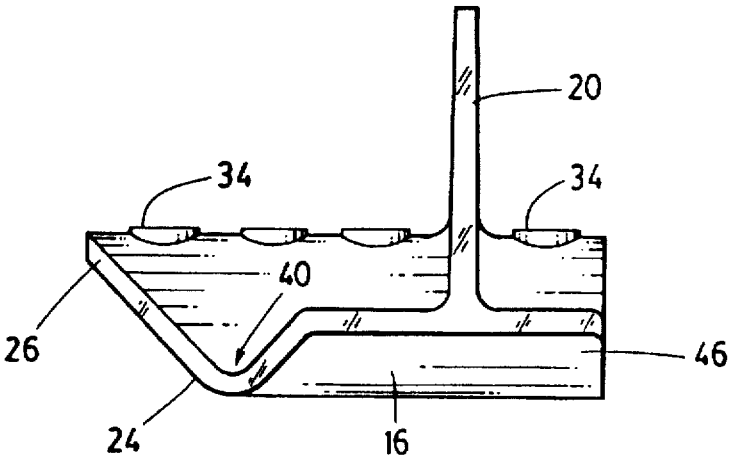
FIG. 4
FIG. 5A
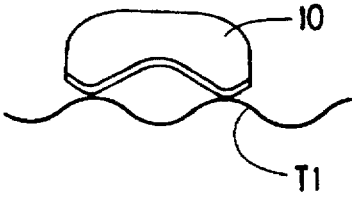
FIG. 5B
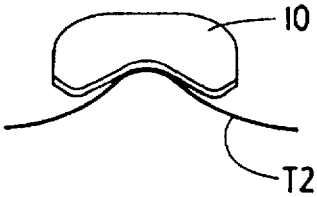
FIG. 5C
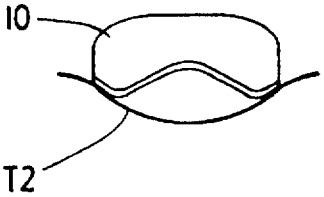
FIG. 5D
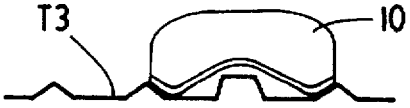
FIG. 5E
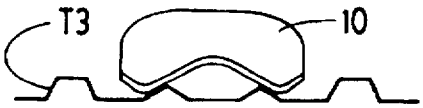

SNOW GUARD

FIELD OF INVENTION

This invention relates to snow guards which are generally fitted to the pitched roofs of buildings adjacent the eaves thereof. The snow guards serve to reduce ice and snow damage to eavestroughs by breaking up the mass of snow and ice that falls from the roof.

BACKGROUND OF INVENTION

One form of snow guard, as described in U.S. Pat. No. 4,141,182 to McMullen, comprises a base and a wing member upstanding from the base. The base is finger like, and of limited width in comparison to the width of the wing member. A commercial product manufactured under the patent has as its base a pair of such finger members laterally spaced apart, and brackets extending between the base and wing member which are much more substantial than the small brackets illustrated in the patent, from which it is apparent that in practice, the snow guards must be more substantially structured than those illustrated in the patent in order to withstand the forces to which they are exposed, thereby increasing the cost of manufacture.

While the aforesaid commercial product is suited for installation on a roof tiled with planar tiles, it is generally unsuited for use with roofs wherein the tiles are undulating. Various forms of undulations are known, particularly where the tiles are formed from sheet metal. Examples of these forms include arcuate corrugations, triangular corrugations and truncated triangular corrugations. In some tiles more than one type of corrugation may be used. It would be desirable that the snow guards be usable with a range of different tiles, including flat tiles and corrugated tiles.

Although it is desirable that the snow guards impede at least in part the shedding of snow from the roof, it is not desirable that they Impede the drainage of water. Accordingly, it is desirable that the contact area between the roof and the snow guard be minimized.

The snow guards are generally low cost items, and any functional improvement should desirably not increase the costs associated therewith, and preferably should serve to decrease costs.

It is a prime object of this invention to provide snow guards that may be used with roof tiles of different profiles.

It is another object of this invention to provide snow guards that do not unduly impede the drainage of water from roofs.

It is still another object of this invention to provide snow guards that are innately stronger than the snow guards of the prior art and that may be more lightly structured to provide an economy of materials.

In accordance with a broad aspect of the invention, in a snow guard having a width and a depth; a base means for securing the snow guard to a roof, and a wing means extending upwardly from the base means, the under surface of the base means is provided with a corrugate profile to define an arch extending generally along the depth of the snow guard, and a pair of synclines having their axes parallel to that of the arch on transversely opposed sides thereof.

The snow guard may be fitted to an arcuately undulating tile with the arch forming a saddle on the arcuate ridge of the tile, and secured with screws or the like passing through the tile ridge. Torsional forces to which the snow guard is exposed will be resisted in part by the interaction between the ridged wall of the tile and the arched wall of the snow guard. Alternatively, the snow guard may be fitted between adjacent tile ridges, or where the distance between the synclines of the snow guard is an exact multiple of the distance between the ridges of the tile, the snow guard may be secured to the tile with the synclines superimposed on the ridges, using screws or like means passing through the ridges.

Suitably and preferably, the synclines have a smaller included angle than that of the arch; also suitably, the synclines are asymmetric, with transversely outward portions thereof being upwardly sloped at a greater angle than are portions transversely inwardly of the lowest point of the syncline. Desirably, the arch and the synclines will be arcuately curved, suitably in circular arcs, the radius of curvature of the arch being appreciably greater than the radius of curvature of the synclines, suitably the radii being in the approximate ratio of 2:1. These preferred features permit the snow guards of the invention to be used with undulating tiles having a wide range of ridge to ridge distances, and also serve to facilitate the drainage of water past the lateral sides of the snow guards.

In non-arcuately undulating tiles, the arched base of the snow guard will generally bridge over undulations in the tile, and the snow guard may be secured to flat portions of the tile with screws or the like passing through the synclines of the snow guard.

Also suitably and preferably, the base means is continuously formed between the arch and the synclines and has a more or less uniform thickness and the wing means is continuously attached to the base means so as to provide a high strength to weight ratio for the snow guard without requiring any brackets or the like between the base means and the wing means.

The foregoing objects and aspects of the invention, together with other objects, aspects and advantages thereof will be more apparent from a consideration of the following description of the preferred embodiment thereof taken in conjunction with the drawings annexed hereto.

BRIEF DESCRIPTION OF THE DRAWINGS

In the drawings,

FIG. 3 is a front elevation of the snow guard of FIG. 1;

FIG. 4 is a side elevation of the snow guard of FIG. 1; and

FIGS. 5A–5E show in schematic front elevation, the snow guard of FIG. 1 mounted on undulating tiles.

DESCRIPTION OF THE PREFERRED EMBODIMENT

Figure 1:
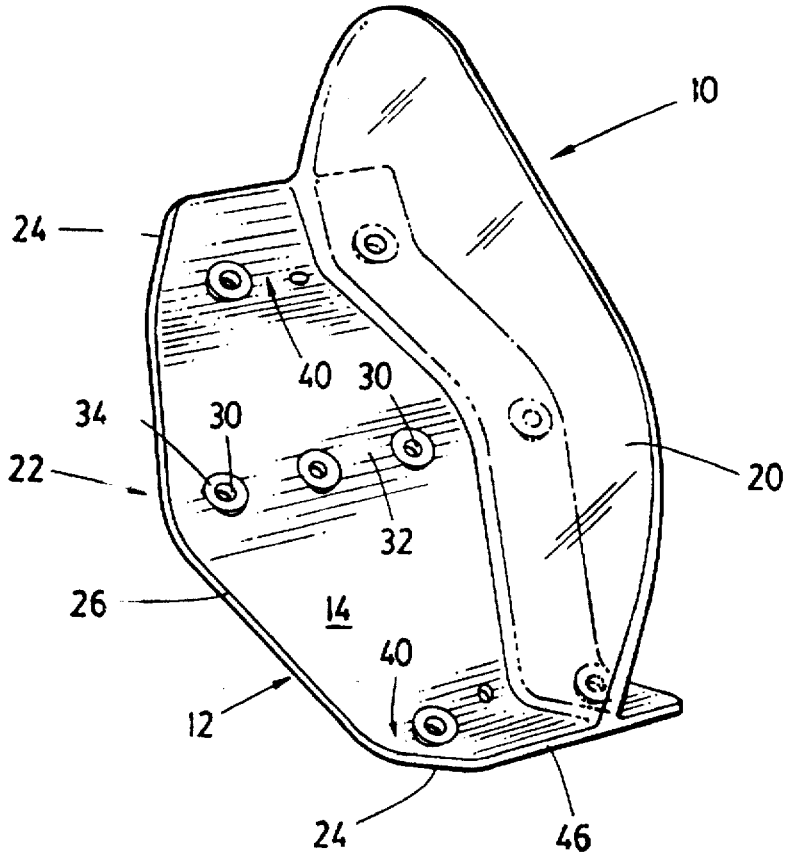
FIG. 1 is a perspective view of a snow guard in accordance with the invention.

Referring to the drawings in detail, a snow guard in accordance with the invention is identified generally therein by the numeral 10. Snow guard 10 comprises a continuously formed base member 12 having an upper surface 14 and a lower surface 16 and having a generally uniform thickness. A wing member 20 is upstanding from the upper surface 14 of the base 12 to extend and attach to generally continuously across the width thereof.

Snow guard 10 is suitably molded as a unitary item from thermoplastic material, but for the purposes of description, base member 12 may be thought of as being made from planar sheet material folded in a corrugate manner to form a central arched portion 22 and a pair of synclines 24 on transversely opposed sides thereof, and parallel thereto aligned along the depth of the snow guard 10.

Figure 2:
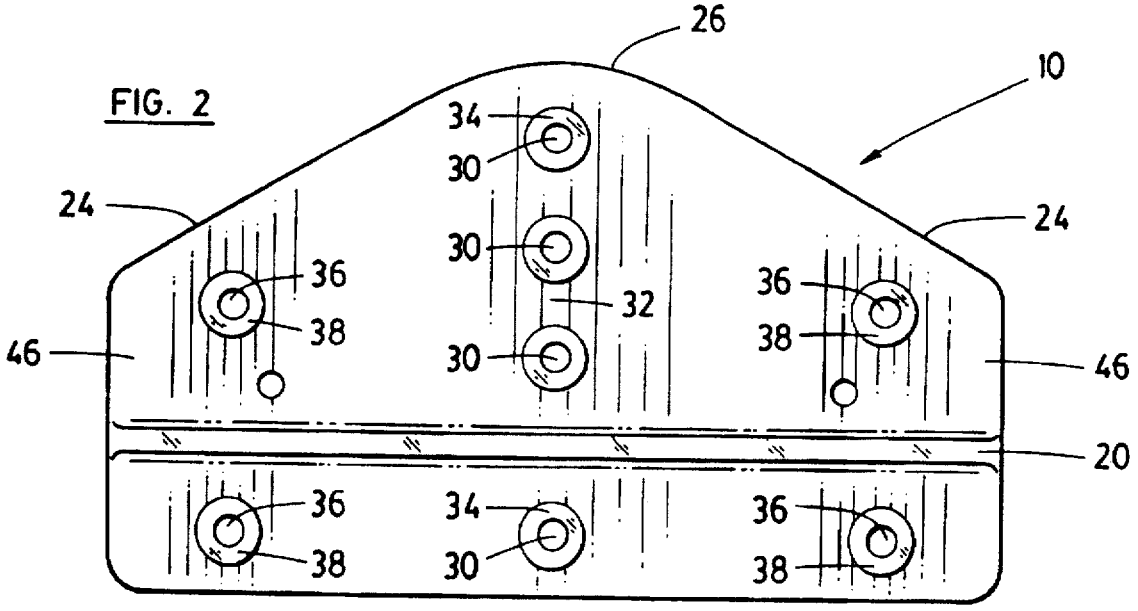
FIG. 2 is a plan view from above of the snow guard of FIG. 1.

In plan form, as best seen in FIG. 2, base member 12 has a generally pentagonal configuration so as to increase the depth ie, the front to back dimension; of the base member more or less progressively along the rearward end 26 thereof towards the arched portion 22 for a purpose to be described. A plurality of vertical openings 30 are provided through arched portion 22, aligned along the apex 32 thereof, each of the openings being surrounded on upper surface 14 by a flat 34. Vertical openings 36 each surrounded by a flat 38 are provided in each syncline 24 through the trough 40 thereof. A drainage opening 42 is formed through base member 12 adjacent to the juncture of wing member 20 and trough 40 on the inward side thereof, ie. that side closest to arched portion 22, rearwardly of wing member 20.

As best seen in FIG. 3, the transverse profile of central portions of base member 12 extending between synclines 24 approximates that of an equilateral triangle, the sides of which are inclined at an angle $\alpha 1$ which suitably has a value of about 30°. Tail portions 46 of the base member 12, which is to say those portions laterally outwardly of troughs 40, are upwardly swept at an angle $\alpha 2$ somewhat greater than that of the angle eel of the inward portions, suitably in the range of about 35° to 40°. The apex of the triangle has an included angle $\beta$ which is substantially greater than the included angle of the synclines 24 which has a value equal to $180°-(\alpha 1+\alpha 2)$. Arched portion 22 is at the apex thereof formed as a circular arc with a radius R1. Synclines 24 are formed over lower portions thereof with a radius R2, the ratio of the radius R1:R2 being approximately 2:1.

Considering now the manner of use of snow guard 10, and with reference to FIG. 5A, a tile T1 is here considered to have a ridge to ridge dimension equal to the distance between the synclines 24 of the snow guard, and the snow guard is most conveniently secured to the tile by means of screws (not shown) which pass through the openings 36 in each syncline and the ridges of tile T1. Suitably, the screws will be flat-headed and a sealing washer (not shown) will provide a water-tight seal onto flats 38. The area of contact between snow guard 10 and tile T1 will be very low, and water drainage will not be impeded. Water which falls onto the snow guard above wing member 20 will drain through drainage openings 42.

Referring now to FIGS. 5B and 5C, the ridge to ridge distance of a tile T2 is here considered to be appreciably greater than the distance between the synclines 24 of snow guard 10. In this instance, snow guard may be secured to tile T2 with the arch portion 22 positioned as a saddle on the tile ridge as seen in FIG. 5B, with screws (not shown) passing through openings 30 in the crown 32 of the snow guard. The increased front to back dimension of snow guard 10 across the crown 32 permits the snow guard to be firmly secured to roof tile T2 and to resist the torsional forces to which it is exposed. Alternatively, as seen in FIG. 5C, snow guard 10 may be secured to tile T2 in the valley of the tile, using screws (not shown) or other suitable securing means passing through the synclines 24. The kicked up tail portions 46 of the base member 12 will permit the snow guard to be fitted in this manner, even in those instances where the tile ridges are formed with a relatively low radius of curvature, and will also facilitate the drainage of water past the snow guard.

In those instances wherein the snow guard 10 is to be secured to undulating roof tiles in the nature of those identified in FIGS. 5D and 5E as T3, wherein the undulations have a non-arcuate form, it will usually be found that the troughs 40 of the snow guard can be seated on flat portions of the tile, with arched portion 20 bridging over the undulations.

As earlier indicated, snow guard 10 is conveniently molded from thermoplastic material, preferably a transparent grade for aesthetic appearance. It is found that due to the inherently stiff nature of the snow guard 10, the material weight is significantly reduced in comparison to known molded plastic snow guards having a flat base design.

It will be apparent that many changes may be made to the illustrative embodiment while falling within the scope of the invention, and it is intended that all such changes be covered by the claims appended hereto.

The embodiments of the invention in which an exclusive property or privilege is claimed are as follows:

1. A snow guard having a width and a depth, a base means for securing the snow guard to a roof, and wing means extending upwardly from the base means generally along the width of the snow guard for impeding the passage of snow, the improvement wherein the undersurface of the base means has a corrugate profile including an arched portion having an axis generally extending along the depth of the base member and pair of synclines parallel thereto on transversely opposed sides thereof.

2. A snow guard as defined in claim 1 wherein said base means has a substantially uniform thickness.

3. A snow guard as defined in claim 2 wherein said base means is substantially continuous across the depth and width thereof.

4. A snow guard as defined in claim 1 wherein said arched portion is defined in part by an apex and each said syncline is defined in part by a trough and wherein said base means is provided with a plurality of openings therethrough for securing said snow guard to an underlying roof, ones of said openings being disposed along the troughs of said synclines, others of said openings being disposed along the apex of said arched portion.

5. A snow guard as defined in claim 4 wherein each said opening is surrounded on the upper surface of said base means by a flat to provide a sealing surface.

6. A snow guard as defined in claim 1 wherein the depth of said base means increases on approach to said apex.

7. A snow guard as defined in claim 1 wherein each said syncline is defined in part by a trough and wherein said synclines are asymmetric, with the slope of said base means forming said synclines being greater in portions thereof residing laterally outwardly of said troughs than in portions residing laterally inwardly thereof.

8. A snow guard as defined in claim 1 wherein said wing means is continuously connected to said base means along substantially the whole of the length of the wing means.

9. A snow guard as defined in claim 1 wherein each of said arched portion and said synclines, are defined by an included angle, the included angle of said arched portion being substantially greater than the included angle of said synclines.

10. A snow guard as defined in claim 1 wherein said arched portion, in the vicinity of the apex thereof is formed with a first radius and said synclines in the vicinity of the trough thereof are formed with a second radius, said first radius being substantially greater than said second radius.

11. A snow guard as defined in claim 1 wherein a drainage opening is formed through said base means adjacent the juncture of each said syncline and said wing means.

12. A snow guard as defined in claim 1 wherein said snow guard is unitarily molded from a translucent plastic material.

13. A snow guard comprising a base and a wing means upstanding from said base for impeding the passage of snow; said base being substantially continuously formed with a sinuous profile defined by a pair of synclines and an arched portion therebetween, and said wing means being substantially continuously secured to said base along the length of said wing means.

14. A snow guard as defined in claim 13 wherein said arched portion has an apex formed with a first radius and said synclines at the lower portions thereof are formed with a second radius, said first radius being substantially greater than said second radius.

15. A snow guard as defined in claim 14 wherein said first radius and said second radius are in the ratio of about 2:1.

* * * * *